United States Patent [19]

Thill

[11] Patent Number: 4,693,205

[45] Date of Patent: Sep. 15, 1987

[54] EGG DECORATING KIT

[75] Inventor: Gerald D. Thill, Eden Prairie, Minn.

[73] Assignee: Spearhead Industries, Inc., Minneapolis, Minn.

[21] Appl. No.: 835,180

[22] Filed: Mar. 3, 1986

[51] Int. Cl.[4] ..... B05C 13/02; B05D 5/06

[52] U.S. Cl. ..... 118/13; 156/62; 206/575; 426/250; 426/300; 428/15

[58] Field of Search ..... 118/13, 501; 206/575; 426/250, 300; 428/15; 33/21.4; 156/62

[56] References Cited

U.S. PATENT DOCUMENTS

| | | | |
|---|---|---|---|
| 1,400,124 | 12/1921 | Wolverton | 101/35 |
| 1,747,704 | 2/1930 | Glaudel | 118/501 X |
| 1,829,645 | 10/1931 | Gibbens | 8/483 |
| 2,105,378 | 1/1938 | Smith | 101/35 |
| 2,876,575 | 3/1959 | Leika | 428/14 X |
| 3,029,936 | 4/1962 | Graber | 428/12 X |
| 3,334,003 | 8/1967 | Edwards | 156/236 X |
| 3,604,558 | 9/1971 | Frerebeau | 434/84 X |
| 3,791,895 | 2/1974 | Le Van | 428/15 X |
| 3,792,163 | 2/1974 | Fudro | 33/21.4 |
| 3,839,989 | 10/1974 | Niederer | 118/13 |
| 3,848,564 | 11/1974 | Kull | 428/15 X |
| 4,370,941 | 2/1983 | Belton | 118/13 |
| 4,520,753 | 6/1985 | Breuninger | 118/13 X |
| 4,531,475 | 7/1985 | Thill | 428/542.2 X |
| 4,584,042 | 4/1986 | Wandroik | 206/575 X |
| 4,599,235 | 7/1986 | Miller et al. | 428/15 X |
| 4,600,592 | 7/1986 | Dobis | 206/575 X |
| 4,647,461 | 3/1987 | Liang | 428/15 X |

*Primary Examiner*—Henry F. Epstein

*Attorney, Agent, or Firm*—James R. Cwayna

[57] ABSTRACT

The structure for decorating eggs which includes a master package and material for the decorating process. Decorating material is provided in a fluid form and is dripped onto the egg while the egg is being held in a position to allow the decorating material to flow thereover and the material is particularly formulated to be fast drying to will as the same runs over the surface of the egg. The apparatus for supporting the egg during the decorating includes a number of support legs arranged in spaced relation to each other to receive an egg placed thereon and hold the same above a drip tray section. The supports are designed to contact the egg on minimal surface areas such that the dye flowing thereover may substantially cover all of the egg or may be simply applied in decorative stripes or other selected patterns. The egg supporting structure includes the upstanding legs arranged in overlying relationship to a tray for collection of excess decorative material. The entire unit is provided as a package and receiving sections for the decorative material are provided with the support and drip trays being removable from the master package.

7 Claims, 5 Drawing Figures

EGG DECORATING KIT

FIELD OF THE INVENTION

This invention relates generally to the apparatus and structure for decorating articles and more particularly to the field of egg decorating and still, more specifically within that field, the structure for supporting the egg during the decorating process.

SHORT SUMMARY OF THE INVENTION

In the preferred form of the invention an entire package is provided which will be normally manufactured of a vacuum formed material such that individual housing sections and use sections may be formed therein and which vaccum forming process will allow the inclusion of perforate or separation lines such that the entire unit may be broken into individual sections for use by more than one person.

The decorative material that is supplied for the unit includes a food coloring fluid with a fast dry additive so that the same will normally adhere to the egg and will dry in a desired pattern as the same flows over the surface of the egg.

Additional total drying time may be required but the drying effect as the material flows over the egg provides a sufficient adherence of coloring material to the egg to accomplish the desired decoration.

The unit, in its complete form, provides a plurality of housings for tubes of the decorating material and a number of support section units are detachably formed intergrally with the housings and each consists of a tray unit having upstanding egg supporting elements therein such that an egg may be placed on the upper surface of the support elements to be elevated from the bottom of the tray. In use, an egg is positioned on the support elements and the decorative material is allowed to drip thereover and dry thereon. It is not necessary that the egg be hand held or otherwise supported and therefore it is possible to decorate the entire surface of the egg either with the material provided or with other decorative materials provided at the user's option.

In the preferred form of the invention, a number of support elements for the article are provided, but it is within the scope of the invention that the number of such supports may be modified with the only concept of the supports being to position the egg for decorating and cover only a limited surace area of the egg such that full decoration may be accomplished. It is also possible with the arrangement of a single or multiple support system that the egg be shifted for additional decorating.

The egg decorating and supporting section includes an underlying tray for the collection of excess decorative material.

BACKGROUND AND OBJECTS OF THE INVENTION

The applicant is totally unaware of any prior art that provides a support system for holding an egg or other article in a position to be decorated while contacting a minimal surface of the article and which substantially supports the article in a manner that does not require additional support or holding elements. In addition to this concept of support the applicant is unaware of the utilization of decorative materials which include rapid dry or hardening additives in other than the cake decorating field for use in frosting of cakes. With applicant's concept the main aspect is to provide a support mechanism with a suggested form of decorative material being supplied. Obviously a user can utilize any decorative material that is desired with the unit properly providing required support for its application and the tray aspect built into applicant's concept provides a collector for unused or excess decorating material.

This concept has not been found in any prior art. Applicant is well aware and has provided previous inventions and articles in this area.

With the applicant's device, the entire package includes the suggested decorative material but primarily includes a support mechanism for the decorating of the eggs. The support structure provides proper support for the article to be decorated while providing support contact on only minimal surface area of the article.

It is therefore an object of applicant's invention to provide the structure for decorating eggs which includes the means for supporting an egg in position for decorating and supporting the egg with relatively minimal surface contact to allow substantial or entire surface coverage of the egg.

It is still a further object of applicant's invention to provide the structure for properly supporting an egg for decoration which includes a collector tray underlying the support elements for the collection of excess decorating material.

It is still a further object of the applicant's invention to provide the means for properly supporting an egg during decoration thereof which includes means of support to permit positioning the egg thereon in any of several selected positions at the user's option to allow application of decoration in many directions or patterns upon the surface of the egg.

It is still a further object of the applicant's invention to provide a dying material or coloring material for the decorating of eggs which provides a non-toxic fluid material with a rapid drying additive such that a high percentage of the material being applied to the surface of the egg will immediately dry thereon as the same drips or rolls over the surface of the supported egg.

These and other objects and advantages of the applicant's invention will more fully appear from a consideration of the accompanying drawings and disclosure.

DESCRIPTION OF THE INVENTION

Figure 1:
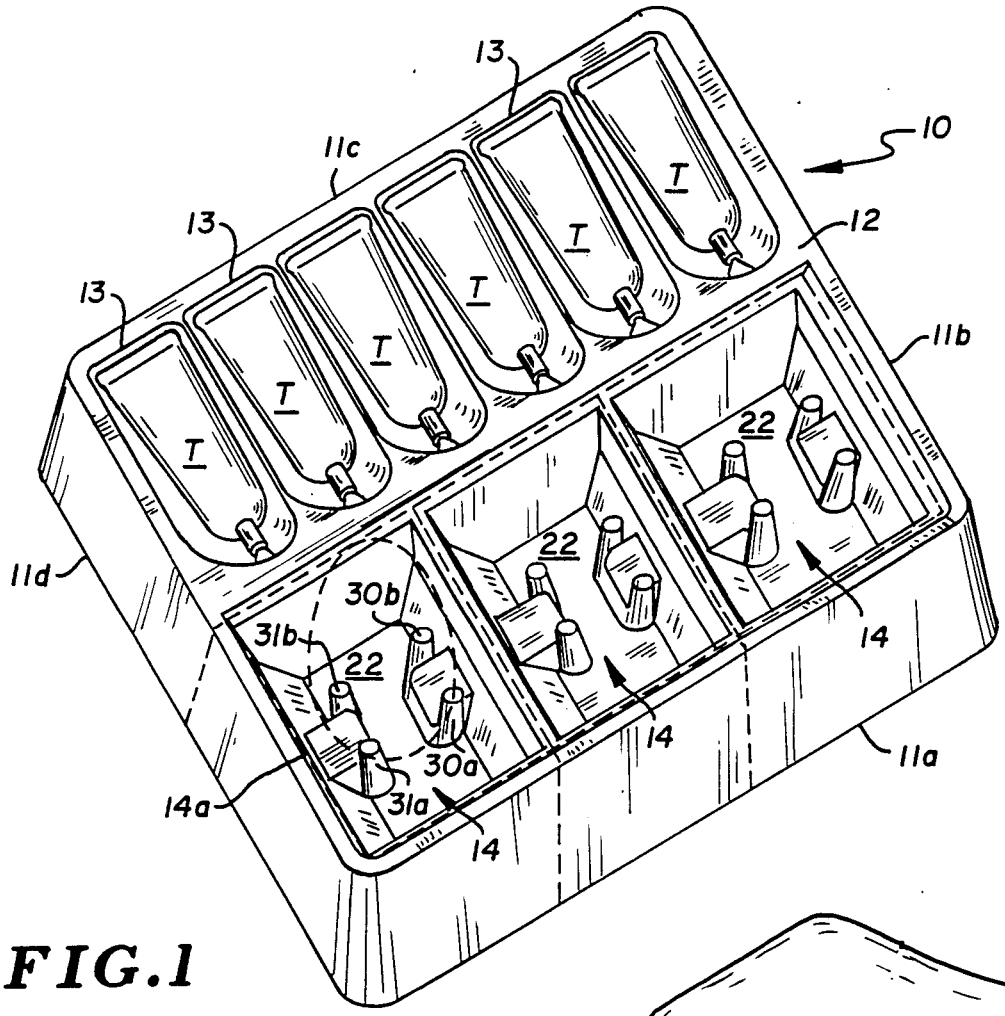
FIG. 1 is a perspective view of a unit which provides all aspects of the applicant's invention and illustrates tubes of decorating material supplied therein and an egg illustrated therein in dotted position in one of the tray-support areas of the entire unit.

In accordance with the accompanying drawings the decorating unit provided by applicant for the egg decorating process is generally designated 10 and, as illustrated, is provided in a unitary structure having upstanding sides 11*a*, 11*b*, 11*c*, 11*d* with the upper surface 12 thereof divided into two distinct areas. The first of such areas consists of a plurality of depressed areas or cavities 13 of a size and breadth to hold a tube or other supply of decorating material. As illustrated tubes of material are provided and designated T.

The second section consists of, in the form shown, three support and decorating tray elements each generally designated 14. As illustrated, each of the tray and support elements 14 is circumscribed by a perforate or scribe line 14*a* to permit separation of the same into three distinct units for individual use. which establishes the inventive concept of this unit.

In the total form the unit then is a segregated structure with a section providing housing for decorative materials and a section supplying a number of support and decorating tray areas.

Figure 3:
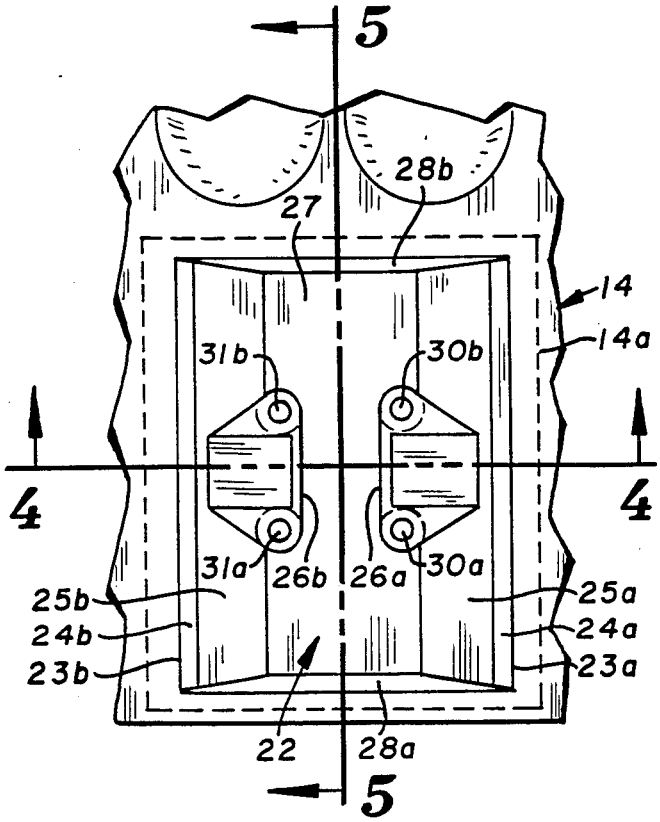
FIG. 3 is a top plan view of the tray-support portion of the unit and illustrating separation or perforation lines for separation of the tray-support section for separate use.
Figure 4:
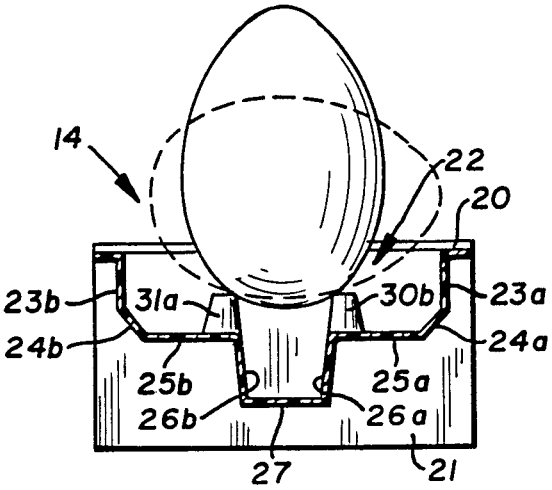
FIG. 4 is a vertical section taken substantially along line 4—4 of FIG. 3 and illustrating an egg in both dotted and solid line positions to show the positionability of the egg on the support structure; and, FIG. 5 is a vertical section taken substantially along line 5—5 of FIG. 3 again illustrating an egg in a decorating position within the tray-support section of the unit.
Figure 5:
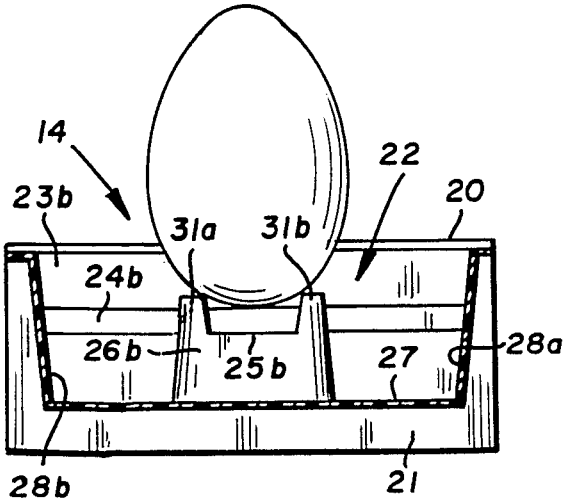

A specific structure of a singular tray unit 14 is best illustrated in FIGS. 3, 4 and 5. As illustrated in these Figures, the individual tray and support sections 14 include an upper surface 20 which is supported above a working surface such as a table through side elements 21 or the like. The inner area of section 14 for supporting the egg and collecting excess dye material basically includes a dished area generally designated 22 extending downwardly from the upper surface 20 and this dished area 22 may, as particularly illustrated in FIG. 4, consist of downwardly extending sides 23*a*, 23*b*; inwardly tapered edges 24*a*, 24*b* and a first flat bottom portion 25*a*, 25*b*. A lower collecting area 27 is formed between the flat bottoms 25*a*, 25*b*, and a pair of downwardly depending sides 26*a*, 26*b* extend from the first flat surface to this lowered area 27. To complete the cavity, downwardly extending ends 28*a*, 28*b* are provided.

Arranged generally centrally of this cavity area are, in the form shown, four upwardly extending support members 30*a*, 30*b*, 31*a*, 31*b*. As illustrated, these upstanding support elements 30*a*, 30*b*, 31*a*, 31*b*, are arranged in position above the two flat sections 25*a*, 25*b*, of the unit such that any excess material not adhered to the egg during decorating will drop into the tray. It should be noted that the specific orientation of these four support elements is such as to minimally contact the egg that is placed thereon. It should also be obvious that although the applicant provides four such upstanding support elements, that other numbers of support elements could be provided. For example, three such elements are a logical arrangement of supports while two such elements would be difficult to properly support an egg unless they were formed with depressed or receiving areas to receive a surface of the egg and were of a relatively large size while a single support could be utilized although it would not be as convenient as a multiplicity of support legs. The basic concept of the invention, then, is to provide a means for supporting an egg during the decorating process above some sort of work surface and preferrably a work surface that provides a receptacle to receive excess decorating materials. Also intergral with this concept is the minimal conatact area of the supports to the egg in order to allow for the most surface coverage of the egg.

Preferrably, the entire unit would be vacuum formed and vacuum forming allows a multiplicty and variety of shapes and lends itself to artistic and functional design. Therefore the drawings should not be taken as a controlling factor in specific shape, size and locations of the various elements.

As stated, the applicant includes in his concept a fluid decorating material. The uniqueness of this particular fluid lies in a rapid drying concept. The fluid is sufficiently liquid so as to flow over the surface of the egg and will dry as it flows thereover, thus adhering to the egg. Additional drying time may be necessary for the complete drying but this is controllable by controlling the amount of additive in the liquid dying material. It is obvious that when dying eggs that will be utilized for ultimate human consumption that USDA approved food coloring materials must used and applicant's ingredients for his decorating material include a mixture of maltrodextrin, water, denatured alcohol serving as a preservative, corn syrup and US certified food colorings including FD&C yellow #5.

Figure 2:
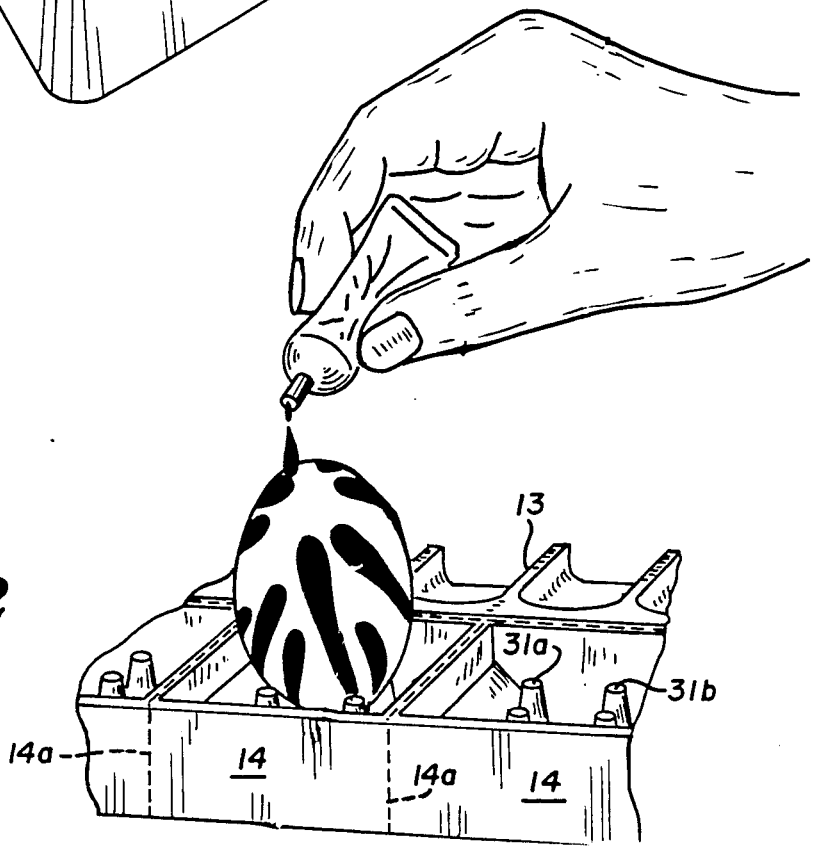
FIG. 2 is a perspective view similar to FIG. 1 illustrating the application of the decorative material to the surface of an egg as the same is supported in the tray-support portion of the unit.

The use of the entire unit should be obvious. Preferrably upon opeing the package, the individual support-tray segments 14 would be separated into single units and the egg is simply placed onto the support elements in a desired position of flow for the fluid being dropped thereon and the selected color is simply held over the egg and the dying material dripped or flowed thereon as illustrated in FIG. 2. As illustrated, the material flows over the egg and the drying takes place, such drying time reduced due to the drying agent added. When another design is desired, it is simply necessary to shift the egg on the support elements and decorate the egg in a new position. The decorattion is not limited to the material supplied and various other decorating materials materials may be utilized without departing from the scope of the invention. During use, the underlying tray will receive any excess materials to eliminate cleanup after using the unit.

It should be obvious that the applicant has provided a new and unique holder for positioning and supporting eggs during the decorating process and has similarly provided a new process for decoration of eggs with a drip or flow type, rapid drying decorating solution.

What is claimed is:

1. An egg decorating kit, including:

a. a base;

b. upwardly directed support means arranged on said base with the uppermost end thereof arranged and constructed to support an egg thereon to hold the egg in elevated position above said base;

c. a collapsible fluid container for releasably containing decorative fluids for application to the egg; and, d. a quantity of decorative fluid in said container releasable therefrom upon the application of collapsing pressure to said container for flow over the surface of the egg for decoration application to the egg.

2. The egg decorating kit set forth in claim 1 and said support means including at least a pair of upwardly directed supports.

3. The egg decorating kit set forth in claim 1 and said support means including a plurality of upwardly directed supports.

4. The egg decorating kit set forth in claim 1 and said base including a cup shaped member having upstanding sides for collection of excess decorative fluid.

5. The egg decorating kit set forth in claim 1 and said decorative fluid having a predetermined drying time whereby at least a portion thereof will dry and adhere to the surface of the egg surface while flowing thereover.

6. The egg decorating kit set forth in claim 1 and a plurality of collapsible fluid containers each provided with a selected decorative fluid for application to the surface of the egg.

7. The egg decorating kit set forth in claim 1 including a plurality of said bases and including a plurality of collapsible fluid container receiving areas whereby a decorating kit for decorating a number of eggs is provided.

* * * * *